United States Patent [19]

Watanabe et al.

[11] 4,235,608

[45] Nov. 25, 1980

[54] ROTARY-TYPE COUNTER-CURRENT HEAT EXCHANGER

[75] Inventors: Hiroshi Watanabe, Fujiyoshida; Ryushi Aoyama, Urawa; Yasuhira Hironaka, Funabashi; Hanji Oana, Iruma, all of Japan

[73] Assignee: ABC Trading Co., Ltd., Japan

[21] Appl. No.: 939,280

[22] Filed: Sep. 5, 1978

[30] Foreign Application Priority Data

| | | | |
|---|---|---|---|
| Sep. 9, 1977 | [JP] | Japan | 52-108591 |
| Sep. 9, 1977 | [JP] | Japan | 52-108592 |
| Sep. 21, 1977 | [JP] | Japan | 52-127121 |

[51] Int. Cl.[3] ..... B01D 53/14

[52] U.S. Cl. ..... 55/181; 55/390; 55/528; 165/7

[58] Field of Search ..... 55/29, 31–34, 55/78, 181, 208, 388, 390, 527, 528, DIG. 17; 165/7, 10

[56] References Cited

U.S. PATENT DOCUMENTS

| | | | |
|---|---|---|---|
| 2,134,544 | 10/1938 | Ashley | 55/34 X |
| 2,344,384 | 3/1944 | Altenkirch | 165/7 X |
| 2,372,437 | 3/1945 | Lathrop et al. | 55/528 |
| 2,700,537 | 1/1955 | Pennington | 165/7 X |
| 2,708,982 | 5/1955 | McGuff et al. | 55/528 |
| 2,792,071 | 5/1957 | Pennington | 55/34 X |
| 3,155,153 | 11/1964 | Axelsson | 165/10 X |
| 3,398,510 | 8/1968 | Pennington | 55/34 X |
| 3,733,791 | 5/1973 | Dravnieks | 55/390 |
| 3,789,916 | 2/1974 | Lindahl | 55/390 X |
| 3,800,859 | 4/1974 | Norback | 55/390 X |

*Primary Examiner*—Robert H. Spitzer
*Attorney, Agent, or Firm*—Steinberg and Blake

[57] ABSTRACT

A heat exchanging element for use in a rotary-type counter-current heat exchanger is provided. The heat exchanging element comprises a gathering member composed of natural fiber, especially coconut fiber. And a rotary-type counter-current heat exchanger is provided. The heat exchanger comprises a casing, a rotary frame rotatably supported by the casing, the rotary frame having a shaft, a pair of rotor rims maintaining a predetermined distance in an axial direction of the shaft and a plurality of rotor spokes, and the heat exchanging element accommodated in the rotary frame.

8 Claims, 27 Drawing Figures

ROTARY-TYPE COUNTER-CURRENT HEAT EXCHANGER

BACKGROUND OF THE INVENTION

The present invention relates generally to a heat exchanger, and in particular to a rotary-type counter-current heat exchanger for exchanging the heat by flowing supply air stream on one side of a center of rotation of a revolving heat exchanging element and flowing an exhaust air stream on the other side in an opposing manner.

Generally, a conventional rotary-type counter-current heat exchanger consists of dividing a cylindrical heat exchanging element rotatably supported in a casing into semicircular portions by means of a center channel, feeding the supply air stream to one side of the thus separated portions and feeding the exhaust air stream to the other side in an opposing manner, and rotating said heat exchanging element so that the heat is continuously exchanged.

In recent years, the heat exchangers of this type have been drawing attention as energy-saving devices because of their installation cost per unit quantity of heat conduction and high heat-recovering efficiency as compared to the heat exchangers of other types.

The heat exchangers of this type have so far employed a heat exchanging element composed of knitting a metal wire in the form of a mesh, or creasing and folding an asbestos paper and laminating it in the form of a beehive. The rotary frame for accomodating the thus prepared heat exchanging elements was usually formed in a cylindrical form, whereby the former heat exchanging element was usually accomodated in a plurality of matrixes formed by dividing the cylindrical rotary frame in the radial direction, and the latter heat exchanging element was usually wound and laminated in said cylindrical rotary frame in concentric with the center of rotation of said frame.

In the heat exchanger of such matrix setup, the sealing between the supply air stream and the exhaust air stream is attained by studding rubber strips called radial seal on one end of each of the matrixes. In the heat exchanger of the laminated construction, on the other hand, the sealing between the supply air stream and the exhaust air stream is attained by providing a ring-like rubber seal on the inner side of the center channel, or by providing a ring-like rubber seal at a suitable place of the casing along the circumferential surface of the heat exchanging element.

Further, the conventional heat exchangers of this type are equipped with a purge sector which works to capture the exhaust air stream that tends to migrate toward the side of supplying the air and return it back to the exhaust air side, in order to prevent the contaminated exhaust air stream from being mixed into the fresh supply air stream beyond the center channel.

However, such a conventional rotary heat exchanger posseses the following fundamental defects. That is, although the heat exchanging element made up of the aforesaid metals exhibited excellent sensible heat efficiency, it was not capable of exchanging the latent heat, resulting in very poor heat-exchanging efficiency as a whole. The heat exchanging element using the asbestos paper, on the other hand, could not be said as a desirable heat exchanging element employing asbestos which is hazardous to the human body and presenting a probability of detonation. Furthermore, the heat exchanging element using the asbestos had to be coated with large amounts of deliquescent salt such as expensive lithium chloride (LiCl) for efficiently carrying out the exchange of latent heat.

Moreover, in the case of the heat exchanging element using the laminate of asbestos papers creased to a pleat in a manner of beehive structure, oil, mist, dirt and dust are gradually accumulated over the entire heat exchanging element as it is used for extended periods of time, causing the heat exchanging efficiency of the heat exchanging element to be inevitably decreased. If the heat exchanging element is washed with water in order to recover the heat exchanging efficiency, the aforesaid deliquescent salt such as lithium chloride which is a medium for exchanging the latent heat is dissolved. Therefore, the maintenance was virtually very difficult. In other words, there was no drastical measure for recovering the heat exchanging efficiency except to replace the heat exchanging element with a new one.

In the case of the heat exchanging element of a metallic member arrayed in a matrix configuration, on the other hand, it was not allowed to clean the element from the radial direction of the rotary frame accomodating the heat exchanging element due to its construction. That is, in order to clean the element, the duct connected to the casing of the heat exchanger had to be removed, requiring cumbersome operation. In any way, it was very difficult to maintain the heat exchanging efficiency of the heat exchanger always in an optimum condition.

Moreover, the heat exchanger using a heat exchanging element made up of metal wires arrayed in a matrix configuration as mentioned above, required the sealing of a very complicated construction between the supply air stream and the exhaust air stream to play an important role as a structure of the heat exchanger of this sort. Particularly, as is well known, the operation for installing the aforesaid radial sealing in the heat exchanger required the most troublesome operation, giving a major cause of interrupting the rationalization of the operation for assembling the rotary-type heat exchangers of this sort.

Furthermore, referring to the structure of a conventional purge sector installed for the heat exchangers of this sort, strict limitation was imposed on the arrangement of a blower for properly functioning the purge sector, presenting considerable inconvenience.

SUMMARY OF THE INVENTION

Generally speaking, according to the present invention, there are provided a novel and improved heat exchanging element for use in a rotary-type counter-current heat exchangers and a rotary-type counter-current heat exchanger using the novel and improved heat exchanging element.

The heat exchanging element for use in a rotary-type counter-current heat exchanger comprises a gathering member, the gathering member being composed of natural fiber, the natural fiber being selected from vegetable fiber, animal fiber or the combination thereof.

Further, according to the present invention, there is provided a rotary-type counter-current heat exchanger comprises a casing, a rotary frame rotatably supported by the casing, said rotary frame including a shaft, a pair of rotor rims maintaining a predetermined distance in an axial direction of the shaft and a plurality of rotor spokes, one end of each rotor spoke being fixed to said shaft and the other end thereof being fixed to said pair of rotor rims, and a heat exchanging element accomodated in said rotary frame, said heat exchanging element consisting of a gathering member, said gathering member being composed of natural fiber, said natural fiber being selected from vegetable fiber, animal fiber or the combination thereof.

Accordingly, the object of the present invention is to provide a heat exchanging element for use in a rotary-type counter-current heat exchanger, having excellent heat exchanging efficiency.

Another object of the present invention is to provide a rotary-type counter-current heat exchanger having excellent heat exchanging efficiency.

A further object of the present invention is to provide a rotary-type counter-current heat exchanger which is capable of stably exhibiting the heat-exchanging function.

A still further object of the present invention is to provide a rotary-type counter-current heat exchanger requiring very easy maintenance.

A still another object of the present invention is to provide a heat exchanger employing a very simply constructed seal between the supply air side and the exhaust air side, maintaining good sealing performance.

Yet further object of the present invention is to provide a rotary-type counter-current heat exchanger employing an improved purge sector, enabling the installation positions of a blower to be selected with wide variation.

Still other objects and advantages of the invention will in part be obvious and will in part be apparent from the specification.

The invention accordingly comprises the features of the construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
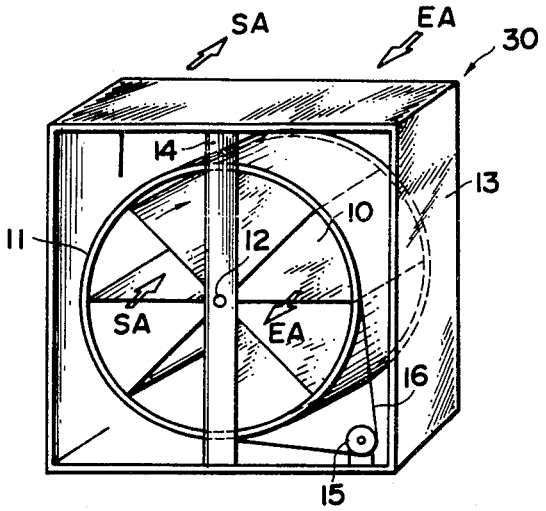
FIG. 1 PRIOR ART
FIG. 1 is a schematic diagram showing a conventional rotary-type counter-current heat exchanger.

Referring first to FIG. 1, a conventional rotary type counter-current heat exchanger is generally denoted by a reference numeral 30. In this heat exchanger, a cylindrical rotary frame 11 for accomodating a heat exchanging element 10 is rotatably supported by a casing 13 by means of a shaft 12. The heat exchanging element 10 accomodated in the cylindrical rotary frame 11 is divided into two semicircular right and left portions as diagramatized by a center channel 14 constituting a portion of the casing 13, whereby a supply air stream SA is allowed to flow on one side and an exhaust air stream EA is allowed to flow on the other side in an opposing manner. The frame 11 is rotated by a drive motor 15 via a belt 16 to continuously exchange the heat.

Figure 2A:
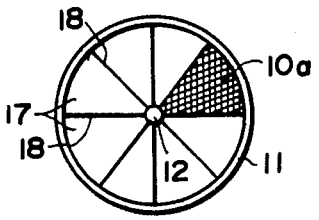
FIG. 2A PRIOR ART
FIG. 2A is a schematic diagram showing a conventional heat exchanging element made up of a metallic member.
Figure 2B:
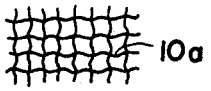
FIG. 2B PRIOR ART
FIG. 2B is a diagram showing on an enlarged scale of the heat exchanging element shown in FIG. 2A.
Figure 3A:
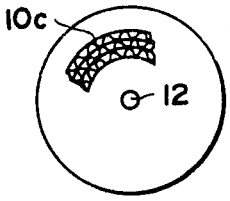
FIG. 3A PRIOR ART
FIG. 3A is a schematic view showing a conventional heat exchanging element made up of an asbestos paper.
Figure 3B:
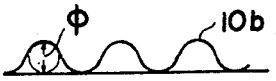
FIG. 3B PRIOR ART
FIG. 3B is a diagram showing on an enlarged scale a portion of the heat exchanging element shown in FIG. 3A.

The conventional heat exchanger 30 of this kind employs a heat exchanging element **10*a* composed of knitted metal wires such as of a stainless steel in the form of a mesh as diagramatized in FIG. 2B, or a heat exchanging element 10*c* composed of winding an asbestos paper 10*b* of a creased and folded shape as shown in FIG. 3B and laminating it in the form of a beehive in concentric with a rotary shaft 12 as shown in FIG. 3A. The former heat exchanging element 10*a* is accomodated in a matrix 17 which is formed by equally dividing the cylindrical frame 11 for accomodating the heat exchanging element 10***a* in the radial direction as shown in FIG. 2A. In the drawings, reference numeral 18 represents a separator plate for forming the individual matrixes 17.

Figure 4:
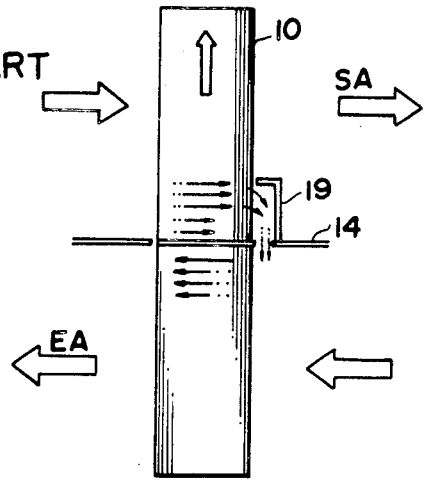
FIG. 4 PRIOR ART
FIG. 4 is a schematic diagram showing a conventional purge sector.
Figure 5A:
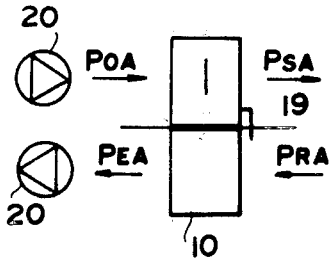
FIG. 5A PRIOR ART
FIG. 5A to FIG. 5D are diagrams showing the states in which the exhaust air stream is transferred into the supply air stream through blowers installed at various positions using the conventional purge sector shown in FIG. 4.
Figure 5B:
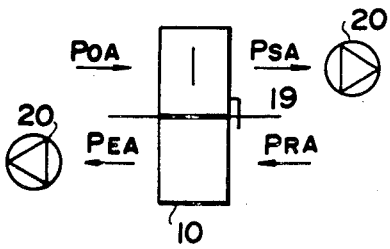
FIG. 5B PRIOR ART
Figure 5C:
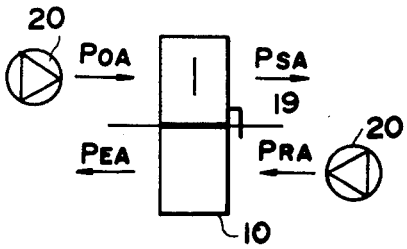
FIG. 5C PRIOR ART
Figure 5D:
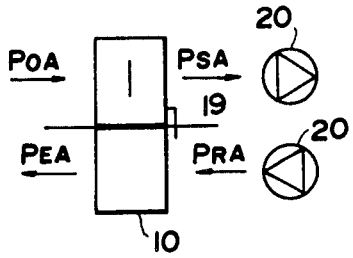
FIG. 5D PRIOR ART

The abovesaid conventional heat exchanger is usually equipped with a purge sector 19 constructed as shown in FIG. 4 in order to prevent the contaminated exhaust stream EA from being mixed into the fresh supply stream SA beyond the center channel 14. The purge sector 19 functions properly when blowers 20 are disposed at positions as shown in FIG. 5A, but is not capable of preventing the exhaust stream from being transferred toward the supply air side when the blowers 20 are disposed in other way than that of FIG. 5A, i.e., when the blowers 20 are disposed at positions as shown in FIG. 5B, FIG. 5C and FIG. 5D. That is, when the blowers 20 are arranged as shown in FIG. 5A, if the static pressures on the side of the open air, on the side of supplying the air, on the side of circulating the air and on the side of exhausting the air are represented by $P_{OA}$, $P_{SA}$, $P_{RA}$ and $P_{EA}$, respectively, the static pressure decreases in the order of $P_{OA}>P_{SA}>P_{RA}>P_{EA}$. Therefore, the air stream is never transferred from the side of circulating the air RA toward the side of supplying the air SA owing to the difference in static pressure. When the blowers are disposed at positions shown in FIGS. 5B, 5C and 5D, for example, when the blowers are disposed at positions shown in FIG. 5B, the static pressure establishes a relation $P_{OA}\cdot P_{RA}>P_{SA}\cdot P_{EA}$. Here, although the static pressures between $P_{OA}$ and $P_{RA}$ and between $P_{SA}$ and $P_{EA}$ will be determined by the difference in capacities of the blowers, the relation of static pressures between the side of circulating the air and the side of supplying the air is $P_{RA}>P_{SA}$, thereby permitting the exhaust air stream to flow from the side RA toward the side SA through the purge sector 19. According to the arrangement of FIG. 5C, also, the relation $P_{RA}>P_{SA}$ is established in the same way as the arrangement of FIG. 5B, thereby permitting the exhaust air stream to flow toward the side SA. According to the arrangement of blowers shown in FIGS. 5B and 5C, the relation in static pressures between the side RA and the side SA is $P_{RA}>P_{SA}$ whereby the static pressure difference between the above two is, in practice, $P_{RA}-P_{SA}=15$ to 30 mm Aq. Therefore, it is virtually impossible to reverse the static pressure relation into $P_{RA}>P_{SA}$ even by changing the blower capacities, and eventually it is difficult to prevent the reversed flow of the exhaust air stream. With the arrangement of FIG. 5D, the static pressure relation is $P_{RA}>P_{EA}>P_{OA}>P_{SA}$ which is quite contrary to that of the arrangement of FIG. 5A; it is quite impossible to prevent the reversed flow of the exhaust air stream.

Below are illustrated in detail a heat exchanging element according to the present invention that is to be compared with the abovementioned conventional examples, and a rotary-type counter-current heat exchanger according to the present invention using the heat exchanging element.

Figure 6:
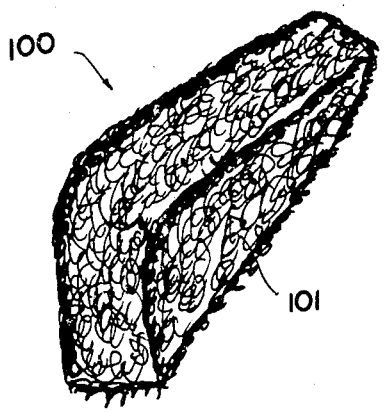
FIG. 6 is a perspective view showing a heat exchanging element according to an embodiment of the present invention.
Figure 7:
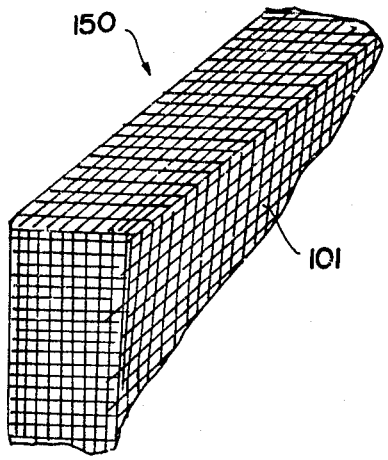
FIG. 7 is a perspective view showing a heat exchanging element according to another embodiment of the present invention.

The heat exchanging elements according to the present invention are denoted by reference numerals 100 and 150 in FIGS. 6 and 7. The heat exchanging element comprises a gathering member. The gathering member is composed of natural fiber 101. The natural fiber 101 is selected from vegetable fiber, animal fiber or the combination thereof. The natural fiber 101 may be agglomerated at random as a gathering member as designated at 100 in FIG. 6, or the natural fiber 101 formed in a mesh-like structure may be laminated at random to form a gathering member as designated at 150 in FIG. 7. In any shape the natural fiber 101 may be agglomerated or gathered, it should have a void nearly equal to that of the conventional heat exchanging elements made of a metal such as stainless steel.

Preferred examples of the natural fiber 101 to be used include coconut fiber, pine fiber, sun tree fiber, wool, cotton, cedar fiber, fir fiber, beech fiber, and zolkova fiber, being used alone or in combination. Specifically, it is preferable to use coconut fiber having a fiber diameter over the range of from 0.1 to 0.4 mm.

The reason why these fibers 101 are selected is because they exhibit great change in hygroscopic property with respect to the change in relative humidity, and relatively large specific heat. That is, the natural fiber 101 used for the heat exchanging element of the present invention may have a specific heat greater than 0.3 $cal.K^{-1}g^{-1}$, and preferably greater than 0.5 $cal.K^{-1}g^{-1}$.

Further, more increased total heat exchanging efficiency will be obtained when the fiber of the heat exchanging element is impregnated with a deliquescent salt or a non-volatile and non-toxic liquid having hygroscopic property, such as lithium chloride, lithium bromide, calcium chloride, ethylene glycol, diethylene glycol, glycerine, titanium chloride, aluminum chloride, triethylene glycol, vanadium fluoride, lithium carbonate, or the like. In this case, further, the deliquescent salt or the hygroscopic liquid needs be used in very small amount as compared to the conventional examples.

The solution concentration when the fiber composition is to be impregnated with these chemical substances may be 100% when the chemical substances are liquids, or may have a concentration of saturated aqueous solution when the chemical substances are solid substances. Further, the amount of the chemical substances that are to be impregnated into the natural fibers may be, in the case of lithium chloride, 40 to 60 g per kilogram of the natural fiber, and in the case of other substances, the amount may usually be 15 to 20 times that of the lithium chloride.

The abovementioned heat exchanging elements accomplished by the inventors of the present application much owe to the following many experiments.

First, in regard to the relation between the construction of the heat exchanging element and the sensible heat exchanging efficiency, test was conducted to determine which one of the conventionally known two constructions, i.e., (1) mesh-like construction and (2) beehive construction, would exhibit higher sensible heat exchanging efficiency. The test was conducted using a mesh-like structure composed of knitting a stainless steel wire of a diameter of 0.25 mm to have a void of 90% as shown in FIG. 2B, and using a beehive structure composed of a laminate of asbestos papers 10*b* having a thickness of 0.15 mm, a hole diameter $\phi$ of 1.3 mm and a void of 79% as shown in FIG. 3B. The weight of the heat exchanging element per unit volume and the amount of air passing through the heat exchanging element were set constant for each of the above structures, to test the sensible heat exchanging efficiencies for each of the abovesaid structures, and the results were theoretically analyzed. As a result, it was found that the mesh-like structure exhibited greater Reynolds number (Re) which is a major factor of determining the sensible heat exchanging efficiency, than the beehive structure. That is, it was found that the mesh-like structure having a greater Reynolds number than the beehive structure could increase the coefficient of heat conduction which is directly related to the sensible heat exchanging efficiency. As will be obvious from Table 1 below, the mesh-like structure exhibits the coefficient of heat conduction which is more than two folds that of the beehive structure.

TABLE 1

| Wind speed in the front (meters per second) | | 2.0 | 2.5 | 3.0 | 3.5 | 4.0 | 4.5 |
|---|---|---|---|---|---|---|---|
| Coefficient of heat conduction ($Kcal/m^2 . h . °C.$) | mesh-like structure | 18.1 | 19.8 | 19.8 | 19.7 | 18.9 | 17.6 |
| | Beehive structure | 7.8 | 7.7 | 7.9 | 8.3 | 8.6 | — |

A series of studies related to the physical properties of the heat exchanging element also revealed that the increased sensible heat exchanging efficiency is attained with the increase of the specific heat of the materials constituting the heat exchanging element, independent of the heat conductivity that was so far regarded to affect the sensible heat exchanging efficiency. For the purpose of reference, specific heats of the substances used for the testing are shown in Table 2.

TABLE 2

| Substance | Specific heat (cal/g°C.) |
|---|---|
| Aluminum | 0.22 |
| Stainless steel | 0.11 |
| Asbestos | 0.19 |
| Wood (fiber) | 0.5–0.7 |
| Cotton | 0.31 |

Figure 8:
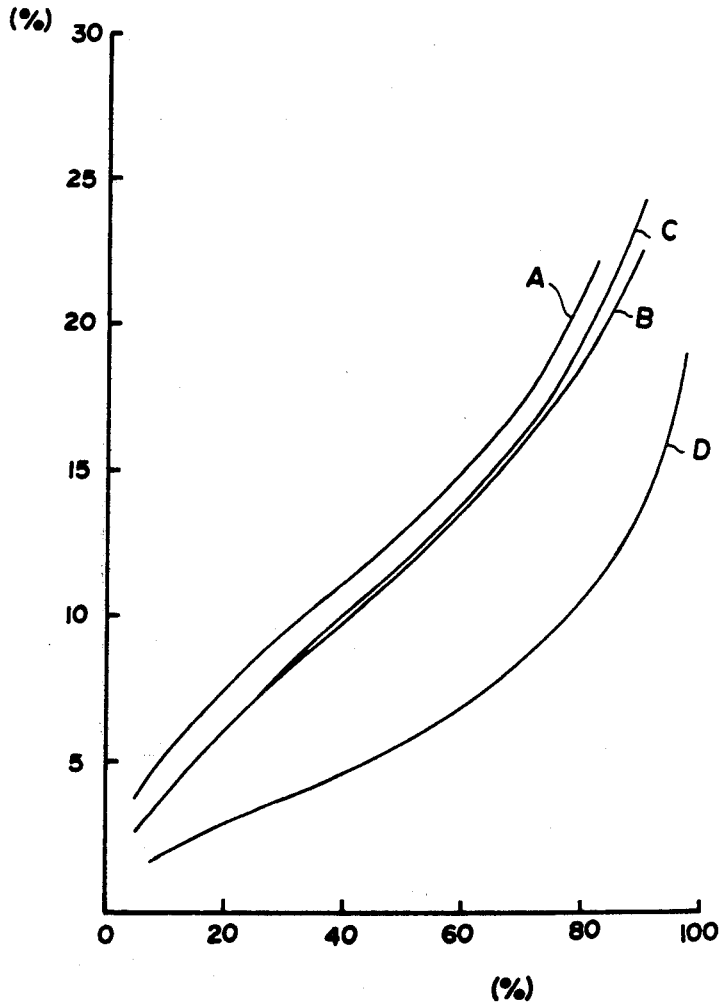
FIG. 8 is a diagram of hygroscopic curves of natural fibers used for the heat exchanging element of the present invention at an equal temperature.

As for the exchange of latent heat, natural fibers having characteristics shown in FIG. 8 were used as a material of the heat exchanging element based on an idea that the substances whose hygroscopic coefficient varies with the change of the relative humidity are suited for use in the latent heat exchanging element. FIG. 8 shows the curves of hygroscopic properties at equal temperature, in which curve A represents the properties of the pine fiber, curve B represents the properties of the sun tree fiber, curve C the properties of the wool, and the curve D the properties of the cotton. In FIG. 8, the ordinate represents hygroscopic rate and the abscissa represents relative humidity.

Below are mentioned concrete experimental examples.

EXPERIMENT 1

Figure 9:
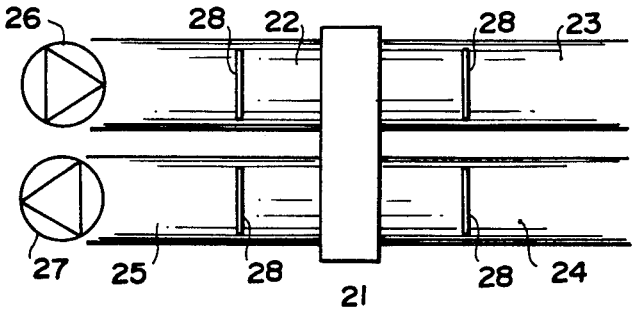
FIG. 9 is a schematic diagram of an apparatus for measuring the total heat exchanging efficiency used for testing the effects of the heat exchanging element of the present invention.

A coconut fiber having a fiber diameter of 0.2 to 0.3 mm formed in a mesh-like structure was installed on the rotary portion as a heat exchanging element in the heat exchanger. One side of the heat exchanging element was brought into contact with a supply air stream, and the other side thereof was brought into contact with an exhaust air stream in a counter-current manner, in order to measure the total heat exchanging efficiency. The results were as shown in Table 3 below. For the purpose of comparison, the results when the stainless steel mesh-like structure was used are also shown in Table 3. FIG. 9 shows the outline of an apparatus used for measuring the abovementioned heat exchanging efficiencies, in which reference numeral 21 designates a heat exchanger, reference numerals 22, 23, 24 and 25 denote ducts, 26 a blower for supplying the air, 27 a blower for exhausting the air, and reference numeral 28 designates terminals for measuring the temperature and humidity.

EXPERIMENT 2

The same heat exchanging element as used in Experiment 1 was immersed in an aqueous solution containing 10 % by weight of lithium chloride for about 2 minutes so that the fiberous tissues (of coconut fiber) were impregnated with the lithium chloride in an amount of 50 g/Kg. The resulting heat exchanging element was measured for its total heat exchanging efficiency in the same manner as in Experiment 1. The results were as shown in Table 3 below.

TABLE 3

| Heat exchanging element | Weight of the heat exchanging element (Kg) | Rotating speed (rpm) | Total heat exchanging efficiency (%) Wind speed (m/s) 2.0 | 2.5 | 3.0 | 3.5 | 4.0 | 4.5 |
|---|---|---|---|---|---|---|---|---|
| Coconut fiber | 3.4 | 15 | 58 | 55 | 53 | 51 | 49 | 47 |
| Coconut fiber impregnated with lithium chloride | 3.6 | 15 | 82 | 80 | 78 | 75 | 71 | 67 |
| Mesh-like stainless steel | 21.3 | 15 | 37 | 36 | 35 | 34 | 31 | 26 |

Figure 10:
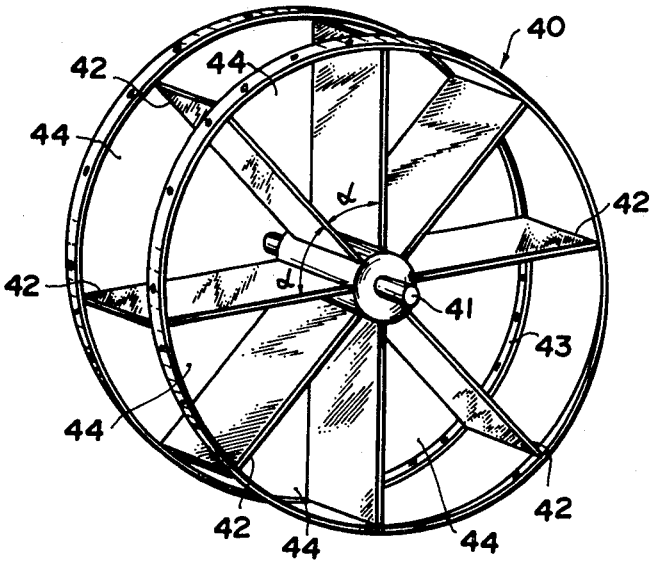
FIG. 10 is a perspective view showing an embodiment of a rotary frame used in the rotary-type counter-current heat exchanger of the present invention.
Figure 11:
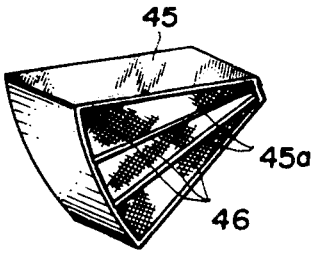
FIG. 11 is a perspective view showing an embodiment of a fan-shaped cartridge accomodating the heat exchanging element according to the present invention.
Figure 12:
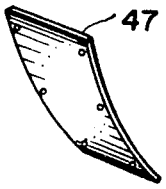
FIG. 12 is a perspective view showing an embodiment of a matrix cover for holding the fan-shaped cartridge shown in FIG. 11.
Figure 13:
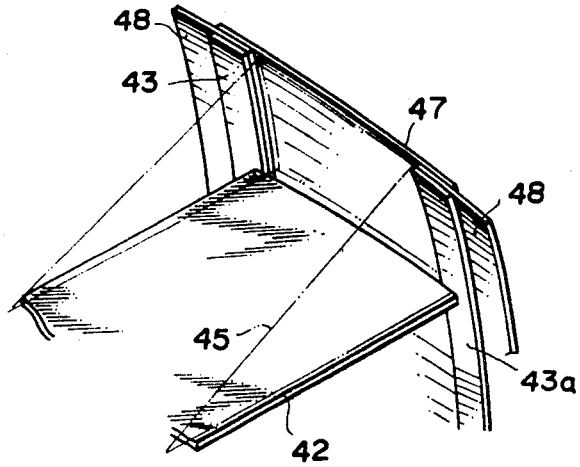
FIG. 13 is a diagram showing on an enlarged scale the outer circumferential portion of the rotary frame to which is fitted the matrix cover shown in FIG. 12.

Below is illustrated the rotary-type counter-current heat exchanger of the present invention using the abovesaid heat exchanging element. FIG. 10 to FIG. 13 show important portions of the heat exchanger. Referring to FIG. 10, the rotary frame designated by reference numeral 40 for accomodating the heat exchanging element consists of a rotary shaft 41, rotor spokes 42, and rotor rims 43. That is, eight plate-like rotor spokes 42 extending in the radial direction are fastened at their ends on one side to the shaft 41 maintaining an equally divided angle $\alpha$, and are fastened at their ends on the other side to the two circularly formed rotor rims 43, 43*a* maintaining an equal distance. In the eight fan-shaped matrixes 44 formed by means of the abovesaid eight plate-like rotor spokes 42 are removably accomodated fan-shaped cartridges 45 of a shape corresponding to the fan-shaped matrixes 44, as shown in FIG. 11. The cartridges 45 contain a predetermined amount of the heat exchanging element 46 of the present invention. The interior of the cartridge 45 may be divided by means of separator plates 45*a*, as required. Each fan-shaped cartridge 45 accomodated in the matrix 44 is supported from the outer circumferential direction of the frame 40 by means of a matrix cover 47 shown in FIG. 12. That is, the matrix cover 47 for holding the fan-shaped cartridge 45 in the matrix 44 is detachably attached to the rotor rims 43, 43*a* by a customary manner such as using screws via a flexible outer circumferential sealing member 48 as shown in FIG. 13.

The thus constructed rotary frame is, although not shown, rotated by known driving system, such as driving motor, pulley and belt. For example, a pulley may be attached to the shaft 41, and the driving motor rotates the pulley to turn the shaft 41.

With the frame for accomodating the heat exchanging element 46 being thus constructed, and the side cover of the casing for rotatably accomodating the frame being detachably attached, it is allowed to very easily keep the maintenance that presented a problem in the conventional counterparts. That is, even when the heat exchanging element is contaminated with oil, mist, dust and dirt after extended periods of use, deteriorating the initial heat exchanging efficiency, the contaminated fan-shaped cartridges can be replaced by the fan-shaped cartridges accomodating new heat exchanging elements simply by removing the matrix covers from the side (radial) direction of the heat exchanger.

Figure 14:
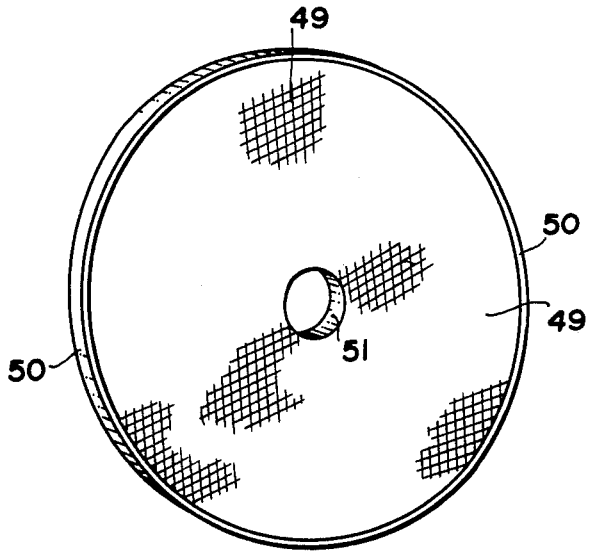
FIG. 14 is a perspective schematic diagram showing an embodiment of a seal structure used for the rotary-type counter-current heat exchanger according to the present invention.
Figure 15:
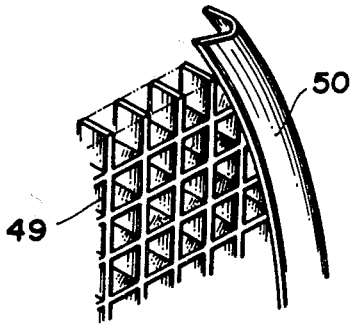
FIG. 15 is a perspective view showing on an enlarged scale the outer circumferential portion of the seal structure shown in FIG. 14.

Below is illustrated the construction of sealing used for heat exchanger of the present invention with reference to FIGS. 14 and 15. The structure of the sealing consists of attaching a pair of circular grid-like plates 49 to the rotor rims 43 and 43*a* shown in FIGS. 10 and 13 by a customary manner. As shown in FIGS. 14 and 15, the grid-like plate 49 is made up of a circular grid having through holes at right angles to the surface of the plate, with a frame 50 being fastened to the periphery thereof. In the drawing, reference numeral 51 represents a hole to which will be fitted the shaft 41 of the frame 40.

Thus, by forming both surfaces of the rotary heat exchanging element using grid-like plates 49 of a very simple construction, the two surfaces provide smooth planes permitting the air stream to flow only in the axial direction of the rotary frame 40 without requiring any particular sealing means such as radial sealing.

Figure 16:
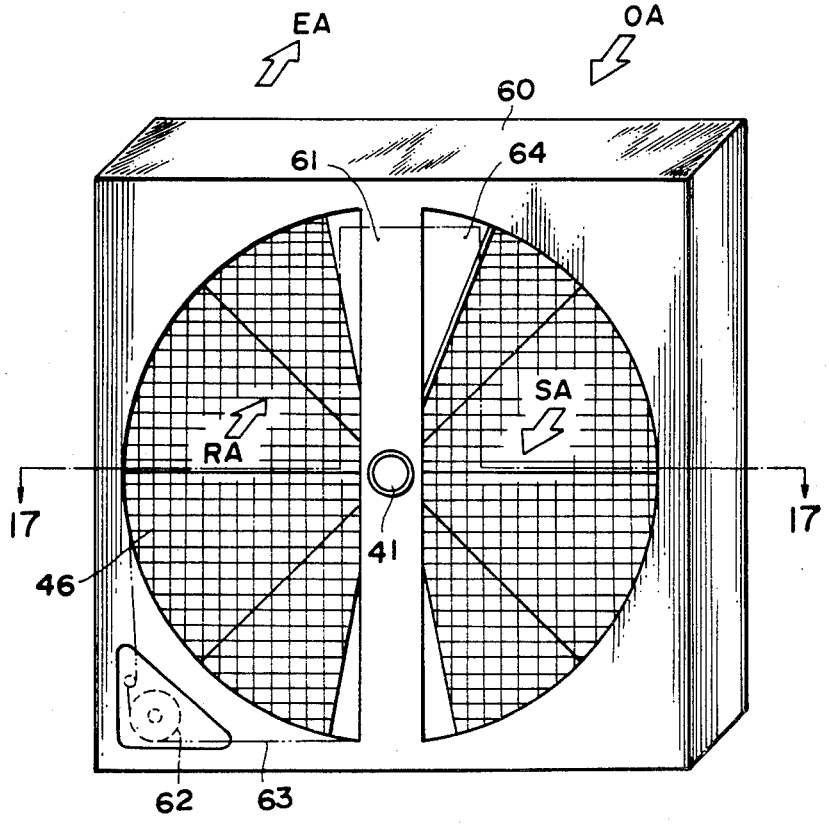
FIG. 16 is a schematic perspective view showing an embodiment of a purge sector used for the rotary-type counter-current heat exchanger according to the present invention.
Figure 17:
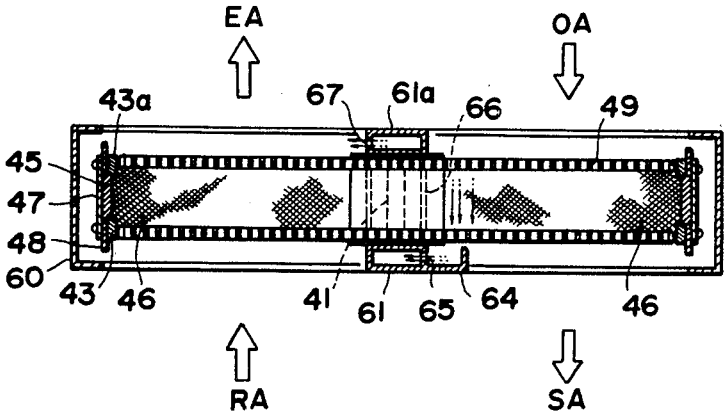
FIG. 17 is a cross-sectional view along the line 17—17 of FIG. 16.
Figure 18:
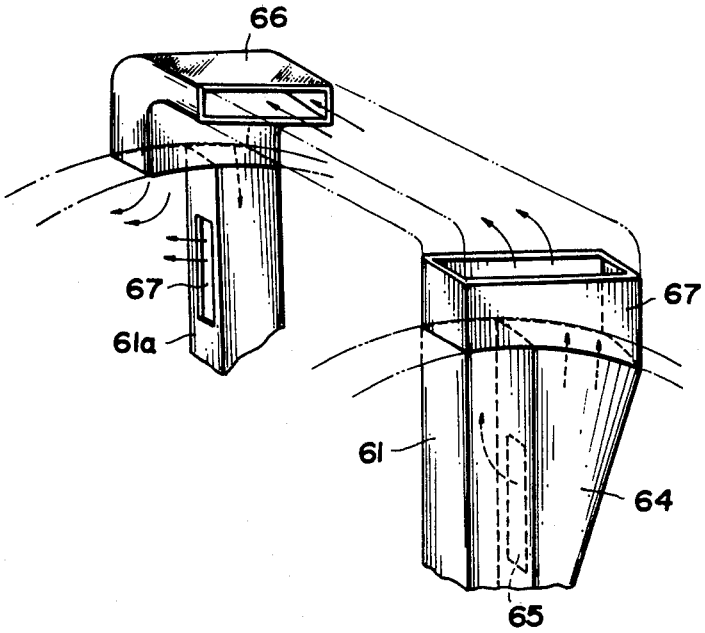
FIG. 18 is a perspective schematic diagram showing on an enlarged scale an embodiment of the purge sector used for the rotary-type counter-current heat exchanger according to the present invention.
Figure 19A:
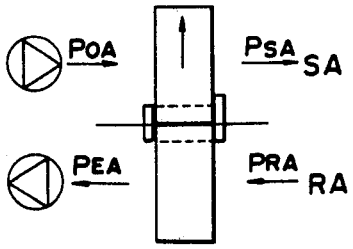
FIG. 19A to FIG. 19D are diagrams showing the states in which the exhaust air stream turns into the supply air stream through blowers located at various positions using the purge sector according to the present invention.
Figure 19B:
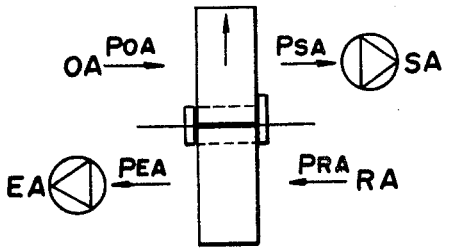
Figure 19C:
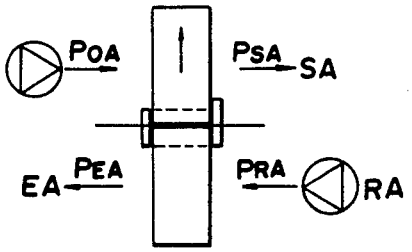
Figure 19D:
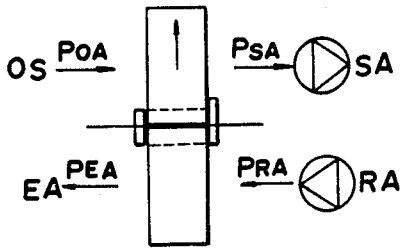

The structure of the purge sector used for the heat exchanger of the present invention can be materialized in the following manner. Referring to FIG. 16 to FIG. 18, reference numeral 46 represents a heat exchanging element, 41 a rotary shaft, 60 a casing, 61 a square cylindrical center channel constituting a portion of the casing, 62 a drive motor, and reference numeral 63 designated a drive belt. The drive motor 62 rotates a pulley (not shown) through the belt 63 to turn the shaft 41. The center channel 61 divides the heat exchanging element 46 into two semicircular portions with the shaft 41 as a center, and functions to seal between the supply air stream side OA→SA and the exhaust air stream side RA→EA. On the supply air side, the fan-shaped purge sector 64 is connected to the center channel 61 on the inner side SA of the supply air side. As shown in FIGS. 17 and 18, the purge sector 64 is communicated to the center channel 61 through an opening 65 which is formed on the side wall on the side of the center channel 61 so as to be communicated to the space in the cylinder. Further, the center channel 61 communicated to the purge sector 64 is connected to a square cylindrical center channel 61*a* located at a symmetrical position on the opposite side of the heat exchanging element 46 through a communication mechanism 66 such as duct disposed on the upper side or the lower side of the heat exchanger. An opening 67 that serves as an exhaust port is formed in a portion of the center channel 61*a*.

The mechanism for preventing the exhaust air stream from being caused to flow in the supply air stream is thus constructed. Therefore, the exhaust stream flow toward the supply air side SA as indicated by arrow is captured by the fan-shaped purge sector 64, caused to flow through the center channel 61 on the supply air side SA, guided toward the center channel 61*a* provided on the exhaust air side EA, and discharged from the opening 67 formed on the exhaust air side EA toward the exhaust air side EA.

The transfer of the exhaust air stream when the blowers are located at various positions is concretely illustrated below with reference to FIGS. 19A, 19B, 19C and 19D. If the static pressures of the external air, supplying air, circulating air and exhausting air are denoted by $P_{OA}$, $P_{SA}$, $P_{RA}$, $P_{EA}$ (the same applies hereinafter in FIGS. 19B, 19C and 19D) with the blowers being located at positions shown in FIG. 19A, the relation among the individual static pressure is given by $P_{OA}>P_{SA}>P_{RA}>P_{EA}$. According to the present invention, the transfer of the exhaust air stream can be prevented if the relation in static pressure differential between the supply side SA and the exhaust side EA satisfies the relation $P_{SA}\geqq P_{EA}$. With the blowers being located at positions shown in FIG. 19A, the relation between $P_{SA}$ and $P_{EA}$ just satisfies the requirement $P_{SA}>P_{EA}$ whereby it is possible to completely prevent the transfer of the exhaust stream. According to the arrangement shown in FIG. 19B, the relation among the individual static pressures is given by $P_{OA}\cdot P_{RA}>P_{SA}\cdot P_{EA}$, and the static pressure differential between $P_{SA}$ and $P_{EA}$ is determined by the capacities of the blowers. Therefore, by so selecting the capacities of the blowers as to satisfy the requirement $P_{SA}\geqq P_{EA}$, it is allowed to prevent the transfer of the exhaust air stream. In other words, the transfer of the exhaust air stream can be completely prevented by setting the capacity of the blower on the supply side SA to be equal to the capacity of the blower on the exhaust side EA, or by setting the capacity of the blower on the exhaust side EA to be slightly greater than the capacity of the blower on the supply side SA. Referring to the arrangement shown in FIG. 19C, the relation among the individual static pressures is given by $P_{OA}\cdot P_{RA}>P_{SA}\cdot P_{EA}$. In this case, also, the static pressure differential between $P_{SA}$ and $P_{EA}$ can be determined by the capacities of the blowers in the same way as that of the arrangement shown in FIG. 19B. Here, in order for the static pressures $P_{SA}$ and $P_{EA}$ to satisfy the relation $P_{SA}\geqq P_{EA}$, the capacity of the blower on the external air side OA should be set to be equal to the capacity of the blower on the circulating side RA, or the capacity of the blower on the circulating side RA should be set to be slightly smaller than that of the external air side OA, to completely prevent the transfer of the exhaust air stream. With the arrangement of FIG. 19D, the relation among the static pressures becomes $P_{EA}>P_{RA}>P_{OA}>P_{SA}$ even if the purge system of the present invention is employed, which is quite contrary to that of the arrangement of FIG. 19A, making it impossible to prevent the transfer of the exhaust stream.

It will thus be seen that the objects set forth above, among those made apparent from the preceding description, are efficiently attained and, since certain changes may be made in the above construction without departing from the spirit and scope of the invention, it is intended that all matters contained in the above description or shown in the accompanying drawings shall be interpreted as illustrative and not in a limiting sense.

What is claimed is:

1. A heat exchanger element for use in a rotary-type counter-current heat exchanger comprising: a gathering member, said gathering member being composed of coconut fiber having a diameter equal to between about 0.1 and 0.4 millimeter.

2. A heat exchanging element as claimed in claim 1, wherein said coconut fiber is impregnated with at least one substance selected from the group consisting of lithium chloride, lithium bromide, calcium chloride, ethylene glycol, diethelene glycol, glycerine, titanium chloride, aluminum chloride, triethylene glycol, vanadium fluoride and lithium carbonate.

3. A rotary-type counter-current heat exchanger comprising: a casing; a rotary frame rotatably supported by said casing, said rotary frame including a shaft, a pair of rotor rims maintaining a predetermined distance in an axial direction of said shaft and a plurality or rotor spokes, one end of each rotor spoke being fixed to said shaft and the other end thereof being fixed to said pair of rotor rims, and a heat-exchanging element accommodated in said rotary frame, said heat exchanging element consisting of a gathering member, said gathering member being composed of coconut fiber having a diameter equal to between about 0.1 and 0.4 millimeter.

4. A rotary-type counter-current heat exchanger as claimed in claim 3, wherein said rotor spoke is plate-like member so that a plurality of said rotor spokes form a plurality of fan-shaped matrixes in said rotary frame.

5. A rotary-type counter-current heat exchanger as claimed in claim 4, wherein said heat exchanging element is contained in a fan-shaped cartridge, and said fan-shaped cartridge is fitted into each said fan-shaped matrix.

6. A rotary-type counter-current heat exchanger as claimed in claim 5, wherein said fan-shaped cartridge fitted to each said matrix is supported by a covering from the circumferential direction of said rotary frame.

7. A rotary-type counter-current heat exchanger as claimed in claim 6, further comprising a pair of grid-like sealing means, each grid-like sealing means being positioned on the front and rear faces of said heat exchanging element in said rotary frame.

8. A rotary-type counter-current heat exchanger as claimed in claim 3, further comprising a purge sector provided on a supply air stream side of said casing and so constructed as to exhaust a captured exhaust air stream toward an exhaust air stream side via duct means without releasing it on a circulating air stream side of said casing.

* * * * *